US008132651B2

(12) United States Patent
Sink et al.

(10) Patent No.: US 8,132,651 B2
(45) Date of Patent: Mar. 13, 2012

(54) MECHANICAL MOTOR FOR TOY PLANES

(75) Inventors: Charles Sink, Friday Harbor, WA (US); Jeffrey James Corsiglia, Toronto (CA)

(73) Assignee: Spin Master Ltd., Toronto, Ontario (CA)

( * ) Notice: Subject to any disclaimer, the term of this patent is extended or adjusted under 35 U.S.C. 154(b) by 1037 days.

(21) Appl. No.: 12/075,334

(22) Filed: Mar. 11, 2008

(65) Prior Publication Data

US 2009/0229921 A1 Sep. 17, 2009

(51) Int. Cl.
*A63H 27/00* (2006.01)

(52) U.S. Cl. ..... 185/39; 185/45; 446/60

(58) Field of Classification Search ..... 185/39, 185/45; 446/57, 59, 60, 459
See application file for complete search history.

(56) References Cited

U.S. PATENT DOCUMENTS

| | | | | |
|---|---|---|---|---|
| 1,366,164 | A * | 1/1921 | Cornish | 446/58 |
| 1,935,534 | A * | 11/1933 | Wilmot et al. | 446/60 |
| 3,721,317 | A * | 3/1973 | Gay et al. | 185/39 |
| 4,318,455 | A * | 3/1982 | Lapierre | 185/39 |
| 4,409,753 | A * | 10/1983 | D'Andrade et al. | 446/164 |
| 5,129,852 | A * | 7/1992 | Crisci et al. | 446/60 |
| 5,390,763 | A * | 2/1995 | Liedtke | 185/39 |
| 6,948,997 | B2 * | 9/2005 | Gregory | 446/60 |

* cited by examiner

*Primary Examiner* — William C Joyce
(74) *Attorney, Agent, or Firm* — Cozen O'Connor

(57) ABSTRACT

An inexpensive apparatus for powering a toy plane including a rubber band motor which is connectable to the plane's propeller and to a winding mechanism, including a gear mechanism which is activated by a handle. As the handle is repeatedly squeezed and released by the user, the motor is wound up. An anti-reversing ratchet is coupled with the motor to prevent unwinding until the user wishes to launch the plane.

8 Claims, 6 Drawing Sheets

MECHANICAL MOTOR FOR TOY PLANES

BACKGROUND OF THE INVENTION

1. Field of the Invention

The present invention relates generally to toy airplanes. Specifically, the present invention provides an inexpensive solution to the problem of powering toy airplanes by using a rubber band and a winding mechanism.

2. Description of Related Art

When designing a toy airplane, it is desirable that it have good performance, be easy to manipulate, and inexpensive to produce. One solution for the production of low-cost toy airplanes has been to use rubber motors, which need to be wound up by the operator before use. However, these have the disadvantage of needing to be wound up a large number of times, as well as being prone to breakage and deterioration.

Accordingly, there is a need for a toy airplane, having a rubber motor which is easily and quickly wound up, and for which replacement parts are inexpensive and easily replaced.

There is also a need for a rubber motor for a toy airplane that can be quickly and easily wound up and then set aside in a fully wound up condition until needed to drive the propeller of the toy airplane.

There is a further need for a rubber motor for a toy airplane that can be quickly and easily connected to a winder for winding up the rubber motor and then quickly and easily connected and to the propeller of a toy airplane to drive the propeller of the toy airplane.

There is also a need for a winder for a rubber motor that can be quickly and easily connected to the rubber motor for winding up the rubber motor and then quickly and easily disconnected from the rubber motor.

SUMMARY OF THE INVENTION

The mechanical motor described herein provides a toy airplane, having a propeller, the propeller having means for engaging a rubber motor, the rubber motor comprising a rubber band with means for engaging the propeller and a winding mechanism for winding the rubber band.

The propeller is a conventional airplane propeller, having means to engage the rubber motor, so that when the rubber motor rotates as it is unwound, the propeller rotates as well, thereby powering the toy airplane.

The rubber motor consists essentially of a rubber band with means to engage the propeller and the winding mechanism. The rubber motor may be concealed in a housing, which may be a hollow tube, and the rubber band and/or the tube may be lubricated, thereby reducing the friction created as the motor unwinds and improving the motor's performance. The motor may further comprise an anti-reversing ratchet, which prevents unwinding until the user wishes to launch the plane.

The winding mechanism has a handle, which at one end is pivotably connected to a housing, and at the other end engages the cogs of a gear, which sits inside the housing, whereby the main portion of the handle is outside the housing. This gear is further connected to a ratchet, thereby ensuring rotation of a main shaft in only one direction. The main shaft is connected to a member protruding from the housing, comprising means to engage the rubber motor. The winding mechanism further includes a clutch mechanism, to prevent overwinding.

According to one aspect then, there is provided a mechanical motor for toy planes, comprising: a rubber band; a housing for containing the rubber band, the housing having an opening at one end; attachment means, connectable to the rubber band via the opening, the attachment means comprising a rotatable element, wherein the rotatable element rotates as the rubber band unwinds; and a winding means, connectable to the rotatable element for winding the rubber band, wherein the winding means is removable from the rotatable element after winding of the rubber band.

In another aspect, there is provided a mechanical motor for toy planes, comprising: a rubber band; a housing for containing the rubber band, the housing having an opening at one end; an attachment means connectable to the rubber band via the opening, the attachment means comprising: a rotatable element, wherein the rotatable element rotates as the rubber band unwinds; a ratchet mechanism, wherein the ratchet mechanism permits winding of the rubber band, the ratchet mechanism having a first position which prevents unwinding of the rubber band and a second position which allows unwinding of the rubber band; and a ratchet release button for moving the ratchet mechanism from the first position to the second position to allow unwinding of the rubber band; and a winding means, connectable to the rotatable element for winding the rubber band, wherein the winding means is removable from the rotatable element after winding of the rubber band.

In a further aspect, there is provided an apparatus for winding a rubber motor of a toy airplane comprising: a housing; activation means connected to the housing; a main shaft having a first extremity within the housing and a second extremity outside the housing; a winding knob located at the second extremity of the main shaft, wherein the winding knob is connectable to the rubber motor for winding the rubber motor; a main gear within the housing, wherein the main gear is rotated by the activation means, and wherein rotation of the main gear in a first direction causes the main shaft to rotate on its axis; and a clutch assembly connected to the main gear and the main shaft, whereby rotation of the main gear is transmitted to the main shaft through the clutch assembly, the clutch assembly configured to prevent over-winding of the rubber motor.

In yet another aspect, there is provided a mechanical motor for driving a propeller of a toy plane, the mechanical motor comprising: a rubber band; a housing for containing the rubber band, the housing having an opening at one end; and attachment means, connectable to the rubber band via the opening, the attachment means comprising a rotatable element, wherein the rotatable element rotates as the rubber band unwinds, the rotatable element being removably connectable to the toy plane for driving the propeller as the rubber band unwinds.

The rotatable element may also be connectable to a winding means for winding the rubber band, the winding means being removable from the rotatable element after winding of the rubber band. The attachment means may include a ratchet mechanism to permit winding of the rubber band, the ratchet mechanism having a first position which prevents unwinding of the rubber band and a second position which allows unwinding of the rubber band. The attachment means may advantageously include a ratchet release button for moving the ratchet mechanism from the first position to the second position to allow unwinding of the rubber band. The rubber band and/or an interior surface of the housing may be lubricated.

It is to be understood that other aspects of the present mechanical motor for toy planes will become readily apparent to those skilled in the art from the following detailed description, wherein various embodiments are shown and described by way of illustration. As will be realized, the mechanical motor for toy planes is capable of other and different embodiments and its several details are capable of modification in various other respects, all without departing from the spirit and scope of the mechanical motor for toy planes described. Accordingly, the drawings and detailed description are to be regarded as illustrative in nature and not as restrictive.

BRIEF DESCRIPTION OF THE DRAWINGS

Referring to the drawings wherein like reference numerals indicate similar parts throughout the several views, several aspects of the applicants' mechanical motor for toy planes are illustrated by way of example, and not by way of limitation, in detail in the figures, wherein.

DETAILED DESCRIPTION OF THE PRESENTLY PREFERRED EMBODIMENTS

The mechanical motor for toy planes shall be described with reference to specific embodiments. Similar numerals are used in all figures to refer to similar components.

Figure 1:
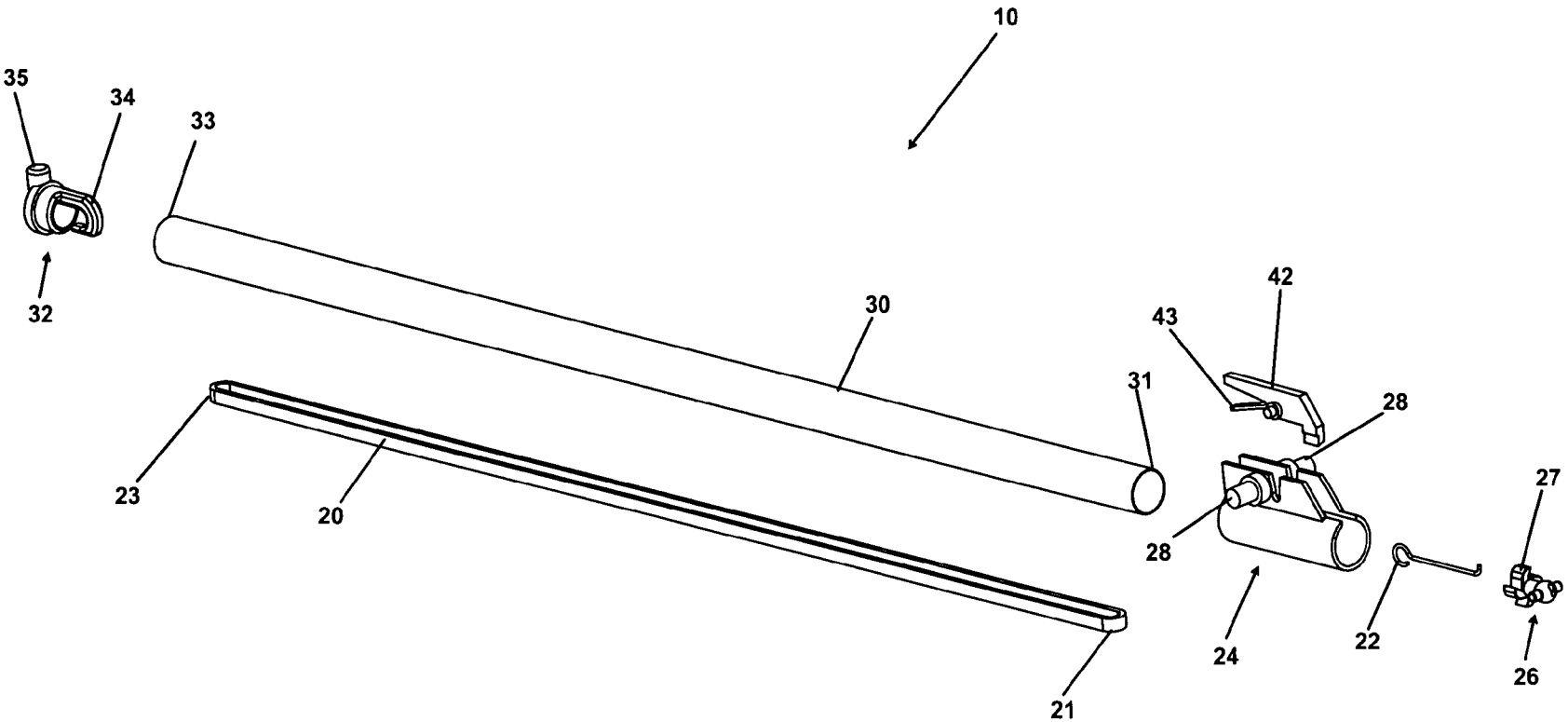
FIG. 1 is an exploded perspective view of one aspect of the rubber motor showing the various parts thereof.

With reference to FIG. 1, the rubber motor, generally indicated by the numeral 10, comprises a rubber band 20, which fits inside a motor housing 30, the motor housing having a proximal end 31 and a distal end 33. A motor attachment member 24 engages motor housing 30 at proximal end 31, the motor attachment member including a hook 22, a motor ratchet gear 26, a catch 42 and side knobs 28. An end-cap 32, which comprises loop 34 and knob 35 engages the distal end 33 of the motor housing. Catch 42, which includes a spring 43, engages with motor ratchet gear 26 to prevent unwinding of the rubber motor until it is released, as is described in greater detail below.

Rubber band 20 is made of a suitably resilient rubber as is known in the art, and has proximal end 21 and distal end 23, which correspond to the proximal end 31 and distal end 33 of motor housing 30, respectively. Proximal end 21 has an aperture therein for receiving and connecting hook member 22, and distal end 23 has an aperture therein for receiving and connecting end-cap 32. In the alternative, rubber band 20 may be loop shaped, as is typical for most common rubber bands, the distal end 23 of which is hooked to the end-cap 32, the proximal end 21 being stretched to engage the hook member 22.

During operation, rubber band 20 is inserted in motor housing 30, which is a cylindrical tube, generally the length of rubber band 20, and with a diameter just slightly greater than the width of rubber band 20. The rubber band 20 and/or the interior surface of motor housing 30 may be lubricated, thereby improving efficiency as less energy is lost to friction between rubber band 20 and the interior surface of the motor housing 30 during the unwinding of rubber band 20. The housing 30 protects the rubber band from exposure to ultraviolet radiation, thus extending its useful life. The housing also prevents the lube from drying out and keeps the lube from getting on the user's hands or clothing.

When assembled, the rubber motor 10 has end-cap 32 engaged with distal end 33 of motor housing 30. Knob 35 protrudes from end-cap 32 and engages the rear of the plane, while loop 34 engages distal end 23 of rubber band 20, thereby ensuring that only proximate end 21 of rubber band 20 rotates as rubber band 20 unwinds.

Figure 5:
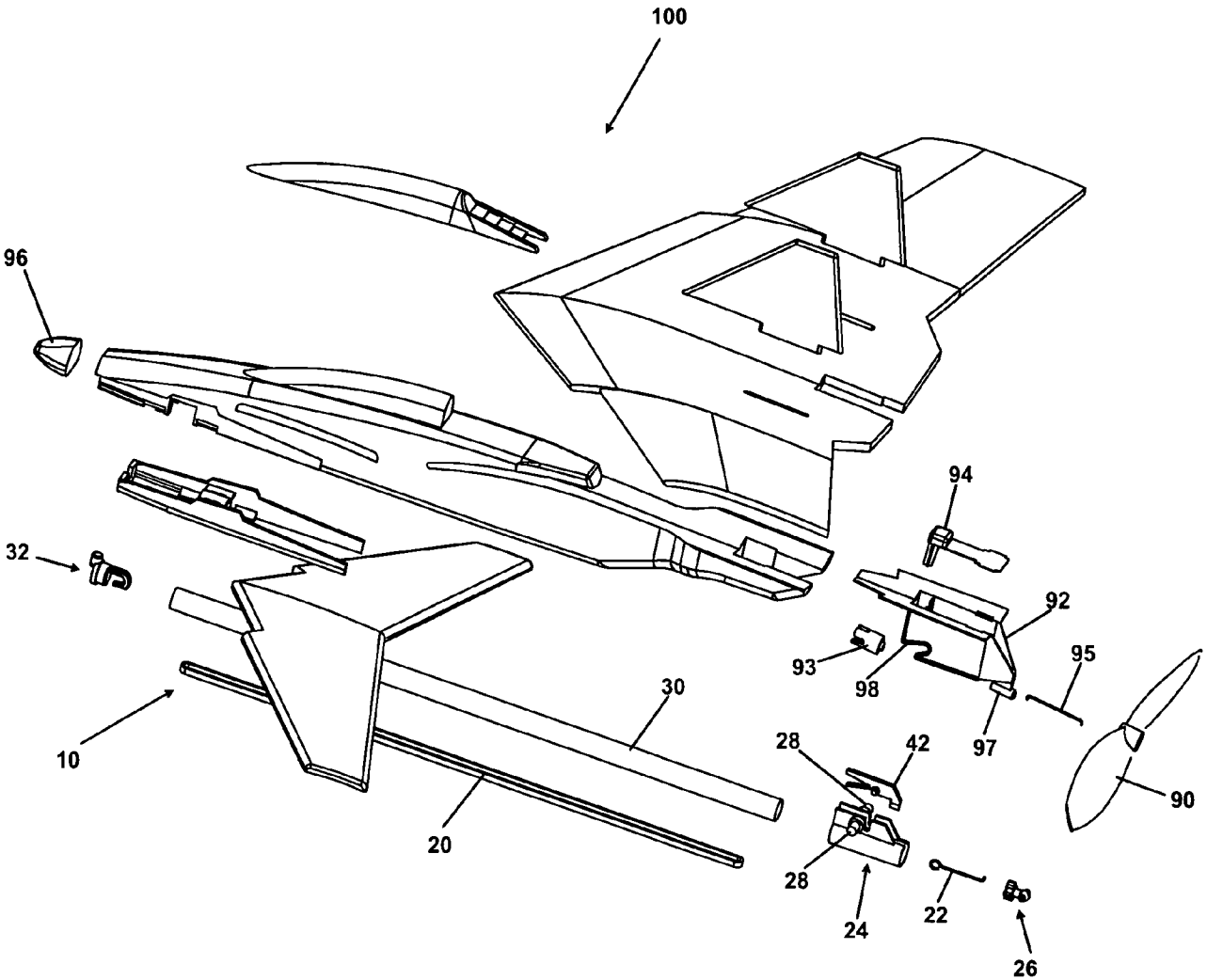
FIG. 5 is an exploded perspective view of the rubber motor and the airplane powered by the rubber motor, showing the various parts thereof.

Motor attachment member 24 engages motor housing 30 at proximal end 31, and provides means for engaging a winding mechanism 50 (see FIG. 3) for winding the rubber band 20 and for driving a propeller 90 of a plane 100 (see FIG. 5).

Figure 2:
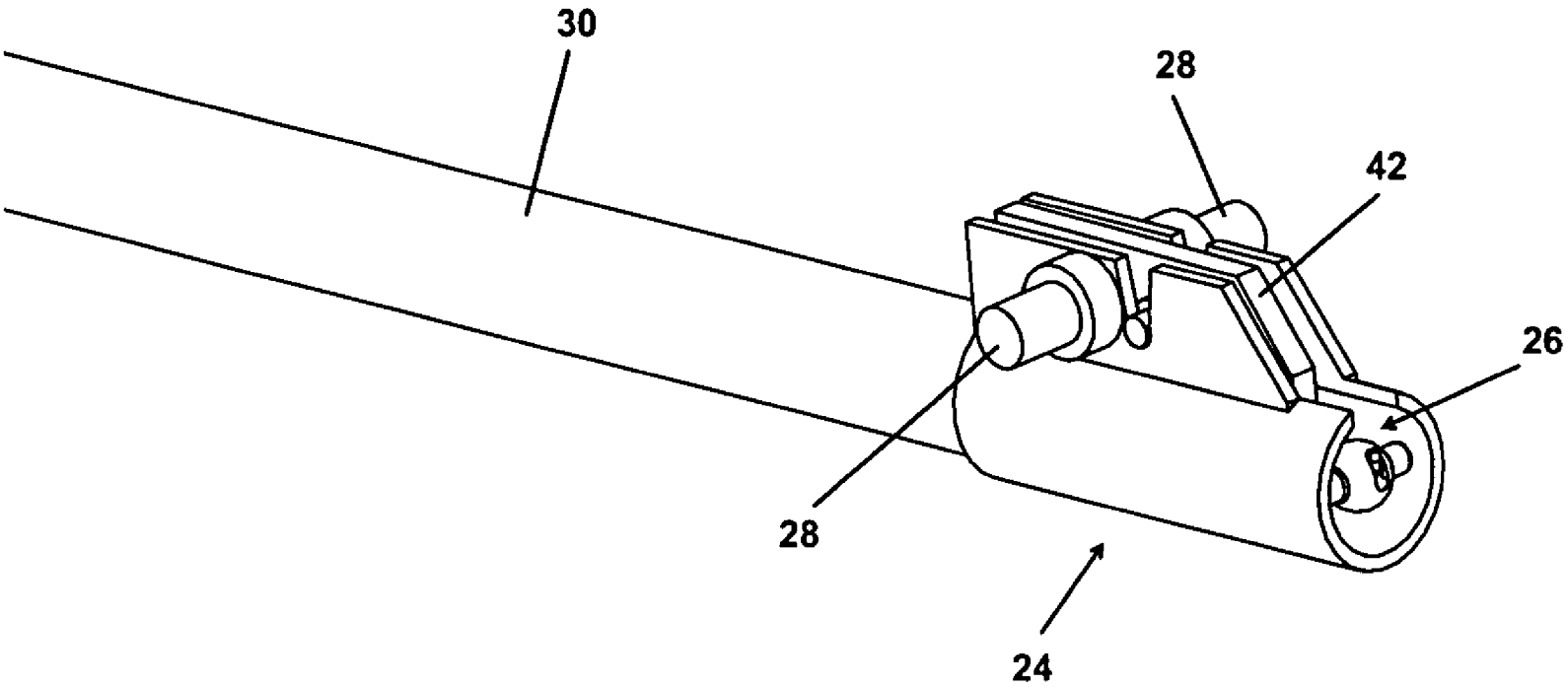
FIG. 2 is a close-up view of the proximal end of the motor housing and the motor attachment member.

FIG. 2 is a close-up view of motor attachment member 24, assembled on housing 30 along with motor ratchet gear 26, catch 42 and support knobs 28. Rubber band 20 is connected to hook 22, which in turn is connected to motor ratchet gear 26. Motor ratchet gear 26 has a plurality of blades 27 (see FIG. 1) arranged radially around the axis of housing 30. Catch 42 engages one of the blades 27 and prevents rotation of motor ratchet gear 26 in one direction. As seen in FIG. 1, the blades 27 are shaped and arranged such that rotation of motor ratchet gear 26 is prevented by catch 42 in the direction of unwinding, but allowed in the direction of winding. Catch 42 is held against the blades 27 of motor ratchet gear 26 by spring 43, thereby preventing unwinding of rubber band 20 until catch 42 is released.

The combination of motor ratchet gear 26 and catch 42 is important since it permits the rubber motor 10 to be wound up and stored for later connection to a plane for driving the propeller of the plane. In that way, a user may continue to drive the plane by removing a spent motor and replacing it with a fully charged motor, without having to stop to rewind the motor. This also permits easy replacement of motors that become damaged.

The winding mechanism of the mechanical motor for toy planes is described in detail below, with reference to the embodiment illustrated in the drawings. However, it will be understood by those skilled in the art that the present invention is not limited by the specific details described herein.

Figure 3:
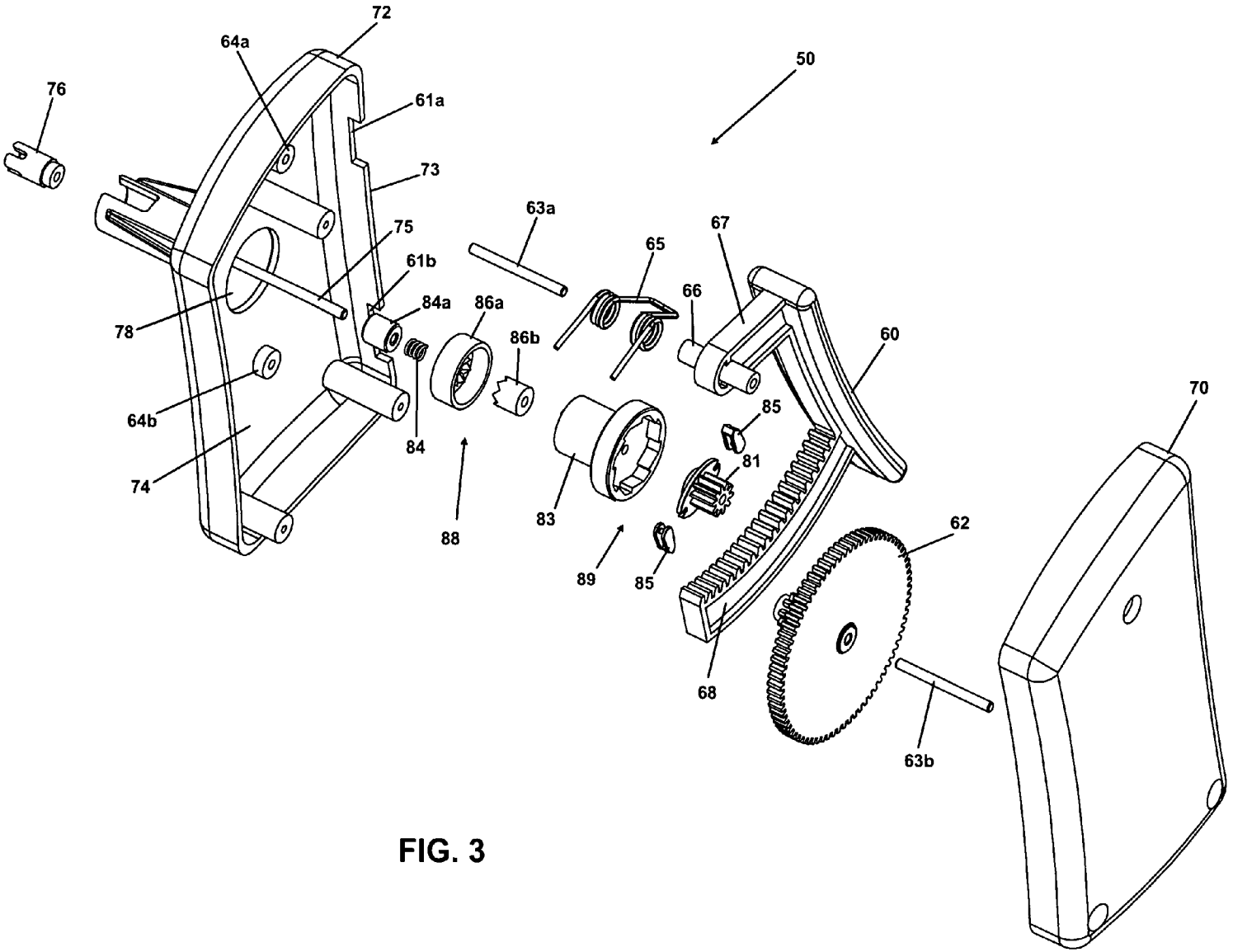
FIG. 3 is an exploded perspective view of the winding mechanism showing the various parts thereof.

Referring now to FIG. 3, which shows the various parts of a winding mechanism 50. The winding mechanism 50 includes a housing, comprising a bottom portion 70 and a top portion 72. The winding mechanism 50 further includes a handle 60, a main gear 62, a main shaft 75, a winding knob 76, support members 63*a* and 63*b*, a spring 65, a clutch mechanism 88, and a ratchet mechanism 89, which are explained in greater detail below with reference to FIG. 4.

In the embodiment shown, top portion 72 of the housing comprises sidewall 73 and top wall 74. Sidewall 73 is fitted with notches 61*a* and 61*b*, which correspond with similar notches on the sidewall of bottom portion 70 (not shown). When the housing is assembled, the notches cooperate to provide openings for a pivot arm 67 and a gear rack 68 of handle 60, respectively.

Adjacent to notch 61*a*, top wall 74 is fitted with support ring 64*a* for receiving one end of support rod 63*a*. Bottom portion 70 has a support ring corresponding to support ring 64*a* for receiving the other end of support rod 63*a*. Support rod 63*a* is used to engage pivot arm 67 of handle 60 through an aperture which corresponds to the pivot point for handle 60. When the housing is assembled, support rod 63*a* is held in place at support ring 64*a* and the corresponding support ring on bottom portion 70.

Similarly, top wall 74 is fitted with support ring 64*b* for receiving one end of support rod 63*b*. Bottom portion 70 has a support ring corresponding to support ring 64*b* for receiving the other end of support rod 63*b*. Support rod 63*b* is used to engage main gear 62 at its center.

Main gear 62 is engaged with gear rack 68, whose internal surface is fitted with gear teeth to mesh with the gear teeth of main gear 62. As shown more clearly in FIG. 4, main gear 62 engages a winder ratchet assembly 89 and a clutch assembly 88 and imparts its rotation thereon. Those skilled in the art will appreciate that the handle 60 described herein could be replaced by other means to power the rotation of main gear 62, as for example, an electric motor.

Figure 4:
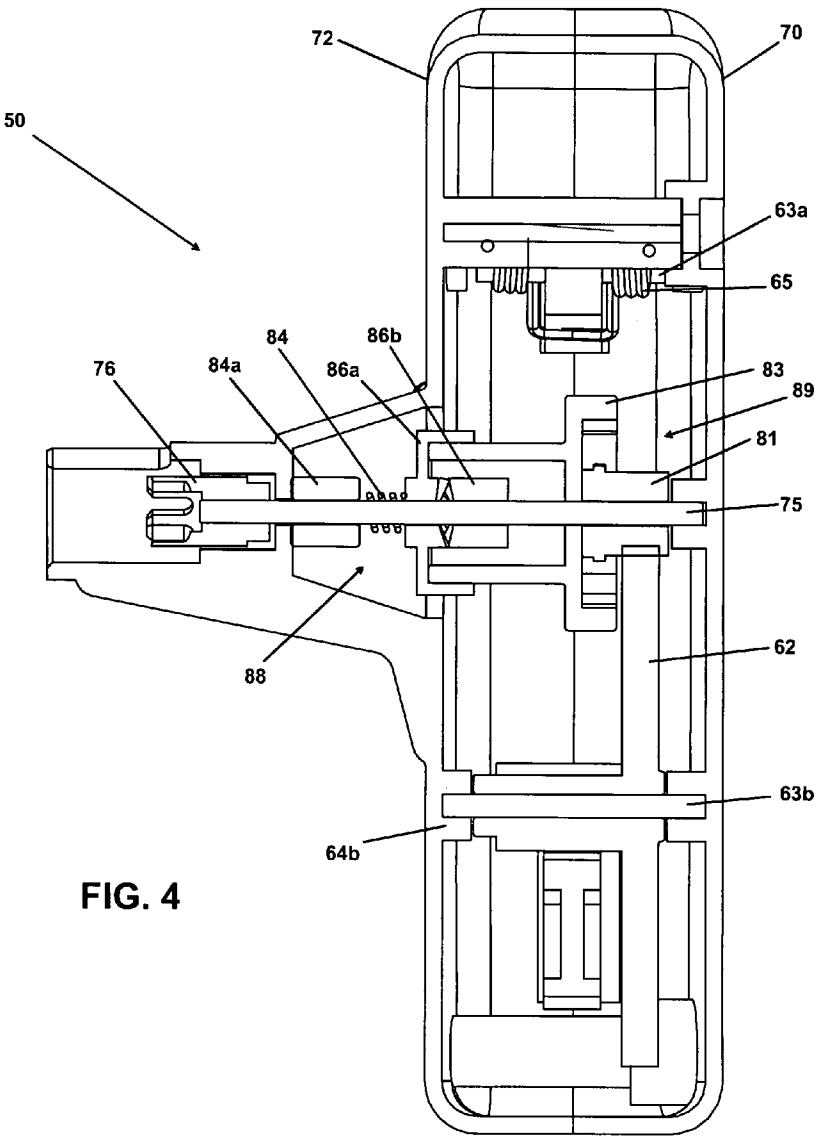
FIG. 4 is a cross-sectional view through the center of the assembled winding mechanism of FIG. 3.

Winder ratchet assembly 89 includes an intermediate gear 81, two shoes 85 and a winder ratchet gear 83. Clutch assembly 88 includes a front clutch gear 86*a*, a rear clutch gear 86*b*, and a spring 84 held in place by a spring retainer 84*a* securely press fit onto main shaft 75. Rear clutch gear 86*b* is secured by press fitting onto main shaft 75 for rotation therewith. Winder ratchet gear 83 and front clutch gear 86*a* are glued together and rest freely for rotation on main shaft 75 through a central aperture. Front clutch gear 86*a* is biased towards the bottom portion 70 of the housing section and against rear clutch gear 86*b* by spring 84. Front clutch gear 86*a* includes a plurality of angled facets facing towards bottom portion 70. The angled facets of front clutch gear 86*a* engage with a similar angled surface on rear clutch gear 86*b*, as shown in FIG. 4.

During operation, and specifically during winding up of the motor, the angled facets of both the front clutch gear 86*a* and rear clutch gear 86*b* are meshed together by spring 84, and rotation of ratchet assembly 89 and clutch assembly 88 is imparted to the main shaft 75. As the motor is wound up, tension in the rubber band increases and more and more force is required to rotate main shaft 75. At some point, the force required to rotate main shaft 75 is greater than the frictional forces produced by spring 84 between the angled faces of the front clutch gear 86*a* and the rear clutch gear 86*b*, resulting in the disengagement of the angled faces from one another, and a slight axial movement of front clutch gear 86*a* away from rear clutch gear 86*b*. This releases main shaft 75 momentarily, and as some tension in rubber band 20 is released, main shaft 75 rotates in a reverse direction until once again, the angled face of the front clutch gear 86*a* and rear clutch gear 86*b* mesh together.

Main shaft 75 extends in opening 78 of top wall 74, and connects with winding knob 76 outside the housing. Therefore, any rotation imparted on the main shaft 75 through clutch assembly 88 is further transmitted to winding knob 76.

Accordingly the user may wind up the rubber motor 10 by connecting winding knob 76 to motor ratchet gear 26 and repeatedly pressing and subsequently releasing handle 60.

Each time handle 60 is pushed inward towards the housing, rotation of main gear 62 is imparted onto intermediate gear 81, which is fitted with shoes 85. Shoes 85 are swung outward by centrifugal force into the teeth of winder ratchet gear 83, which are shaped and arranged such that when spinning in one direction shoes 85 lock into the teeth transferring torque through the clutch assembly 88 to the main shaft 75, but when spinning in the opposite direction, shoes 85 are merely dragged around without engaging the teeth of winder ratchet gear 83. Therefore, when the handle 60 is released and allowed to move back out of the housing, rotation of intermediate gear 81 in the opposite direction is not imparted to main shaft 75. Ratchet assembly 89 is therefore a one-way ratchet permitting the rubber motor 10 to be wound up when the handle 60 is pushed inward toward the housing, but not unwound when the handle 60 is released and allowed to move out of the housing.

Spring 65 of the winding mechanism 50 may be used to bias handle 60 in a raised first position, wherein gear rack 68 of handle 60 is generally outside the housing, as opposed to a depressed second position, wherein gear rack 68 is generally inside the housing. Spring 65 is held by a spring support 66 and engages handle 60 in a manner that is well known in the art.

Referring now to FIG. 5, an exploded view of the rubber motor 10 and the airplane 100 powered by the rubber motor 10 is shown. Importantly, the airplane includes a propeller 90 at the front, and an anchor 96, at the rear. Anchor 96 provides a connection between the plane 100 and the motor 10 at the distal end 33 of housing 30, ensuring that the distal end 23 of rubber band 20 remains stable relative to the plane while rubber band 20 unwinds.

Figure 6:
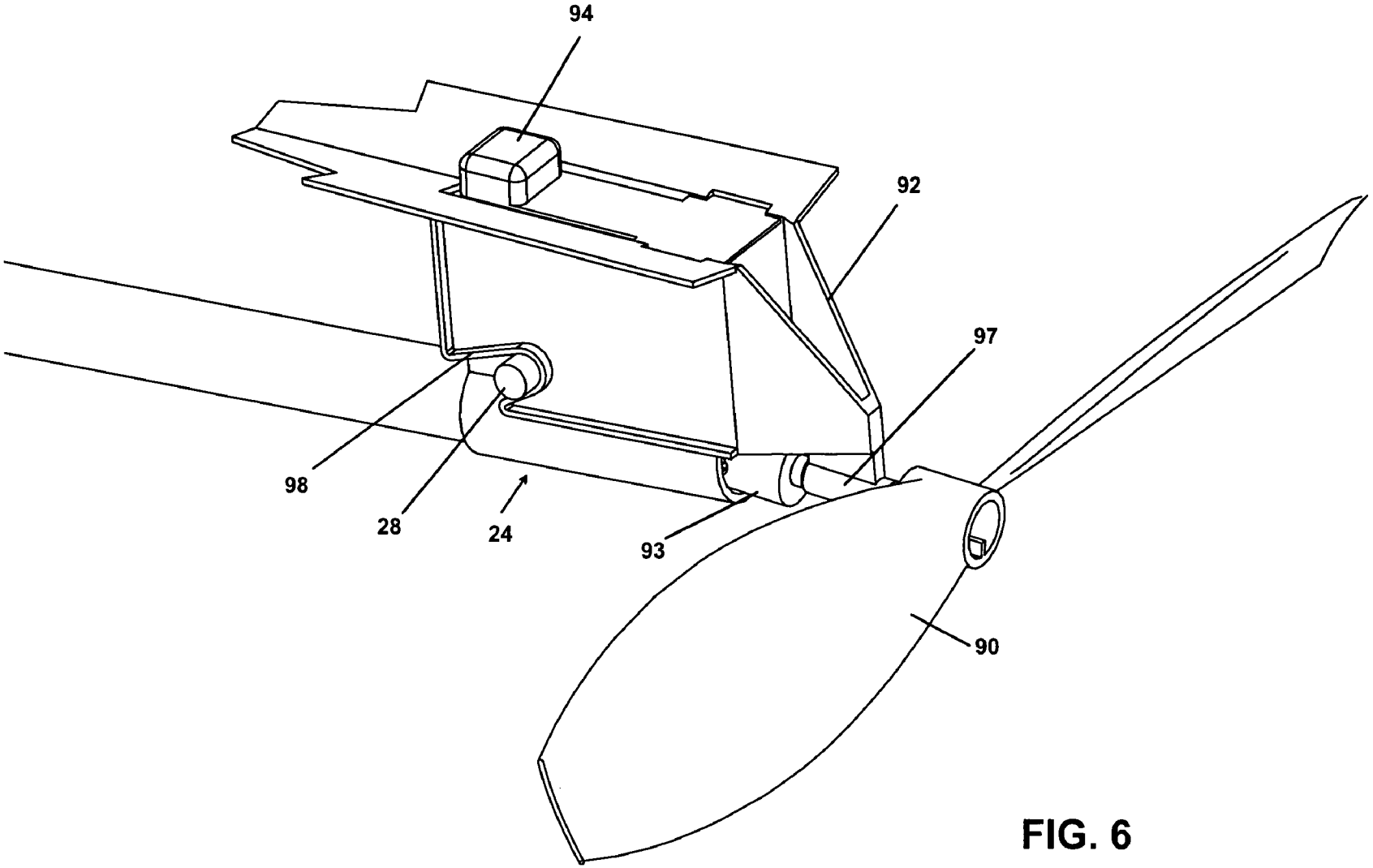
FIG. 6 is a close-up view of the connection between the rubber motor and the toy airplane.

In the embodiment shown in FIG. 5, side knobs 28 of motor attachment member 24 extend laterally therefrom for engagement with corresponding slots 98, of a plane attachment member 92, as shown more clearly in FIG. 6. Plane attachment member 92 further includes plane connecting member 93 which engages motor ratchet gear 26 of rubber motor 10 to form a universal joint. Propeller 90 is attached to connecting member 93 via a hook 95, which fits in a sleeve 97, thereby completing the connection from the rubber motor 10 to the propeller 90.

Also shown in FIGS. 5 and 6, attachment member 92 has a ratchet release button 94, which can be pressed to release and hold catch 42 away from blades 27 of motor ratchet gear 26, thereby allowing the rubber band 20 to unwind when desired by the operator. As previously mentioned, this is an important feature, since it permits the rubber motor 10 to be wound up by winder 50 and stored for later connection to plane 100 for driving the propeller 90 of the plane. In this way, a user may continue to drive the plane by removing a spent motor and replacing it with a fully charged motor, without having to stop to re-wind the motor. This also permits easy replacement of motors that become damaged.

The previous detailed description is provided to enable any person skilled in the art to make or use the applicants' mechanical motor for top planes. Various modifications to the embodiments described will be readily apparent to those skilled in the art, and the generic principles defined herein may be applied to other embodiments without departing from the spirit or scope of the mechanical motor for top planes described herein. Thus, the present mechanical motor for top planes is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed is:

1. A mechanical motor for toy planes, comprising:

a rubber band;

a housing for containing said rubber band, said housing having an opening at one end;

attachment means, connectable to said rubber band via the opening, said attachment means comprising a rotatable element, wherein said rotatable element rotates as said rubber band unwinds; and a winding means, connectable to said rotatable element for winding said rubber band, wherein said winding means is removable from said rotatable element after winding of said rubber band, said winding means comprising:

a housing;

activation means connected to said housing;

a main shaft, having a first extremity within said housing and a second extremity outside said housing, wherein operation of said activation means rotates said main shaft on its axis;

a winding knob located at said second extremity of said main shaft, wherein said winding knob is connectable to said rotatable element for winding said rubber band;

a main gear within said housing, wherein said main gear is rotated by said activation means, and wherein rotation of said main gear causes said main shaft to rotate on its axis; and a ratchet mechanism connected to said main gear and said main shaft, whereby rotation of said main gear in a first direction is transmitted to said main shaft through said ratchet and whereby said ratchet prevents rotation of said main gear in a second opposite direction from being transmitted to said main shaft.

2. The mechanical motor for toy planes according to claim 1, wherein said ratchet mechanism permits winding of said rubber band, said ratchet mechanism having a first position which prevents unwinding of said rubber band and a second position which allows unwinding of said rubber band.

3. The mechanical motor for toy planes according to claim 2, wherein said attachment means includes a ratchet release button for moving said ratchet mechanism from said first position to said second position to allow unwinding of said rubber band.

4. The mechanical motor for toy planes according to claim 1, wherein said rubber band and/or an interior surface of said housing is lubricated.

5. The mechanical motor for toy planes according to claim 1, wherein said rotatable element is removably connectable to a toy plane for driving a propeller of the toy plane as the rubber band unwinds.

6. A mechanical motor toy planes, comprising:

a rubber band;

a housing for containing said rubber band, said housing having an opening at one end;

an attachment means connectable to said rubber band via the opening, said attachment means comprising:

a rotatable element, wherein said rotatable element rotates as said rubber band unwinds and wherein said rotatable element is removably connectable to a toy plane for driving a propeller of the toy plane as the rubber band unwinds;

a ratchet mechanism, wherein said ratchet mechanism permits winding of said rubber band, said ratchet mechanism having a first position which prevents unwinding of said rubber band and a second position which allows unwinding of said rubber band; and a ratchet release button for moving said ratchet mechanism from said first position to said second position to allow unwinding of said rubber band; and a winding means, connectable to said rotatable element for winding said rubber band, wherein said winding means is removable from said rotatable element after winding of said rubber band.

7. A mechanical motor for toy planes, comprising:

a rubber band;

a housing for containing said rubber band, said housing having an opening at one end;

attachment means, connectable to said rubber band via the opening, said attachment means comprising a rotatable element, wherein said rotatable element rotates as said rubber band unwinds; and a winding means, connectable to said rotatable element for winding said rubber band, wherein said winding means is removable from said rotatable element after winding of said rubber band; said winding means comprising:

a housing;

activation means connected to said housing;

a main shaft, having a first extremity within said housing and a second extremity outside said housing, wherein operation of said activation means rotates said main shaft on its axis;

a winding knob located at said second extremity of said main shaft, wherein said winding knob is connectable to said rotatable element for winding said rubber band;

a main gear within said housing, wherein said main gear is rotated by said activation means, and wherein rotation of said main gear causes said main shaft to rotate on its axis; and a clutch assembly connected to said main gear and said main shaft, whereby rotation of said main gear is transmitted to said main shaft through said clutch assembly, said clutch assembly configured to prevent over-winding of said rubber band.

8. A mechanical motor for toy planes, comprising:

a rubber band;

a housing for containing said rubber band, said housing having an opening at one end;

attachment means, connectable to said rubber band via the opening, said attachment means comprising a rotatable element, wherein said rotatable element rotates as said rubber band unwinds; and a winding means, connectable to said rotatable element for winding said rubber band, wherein said winding means is removable from said rotatable element after winding of said rubber band; said winding means comprising:

a housing;

activation means connected to said housing;

a main shaft, having a first extremity within said housing and a second extremity outside said housing, wherein operation of said activation means rotates said main shaft on its axis;

a winding knob located at said second extremity of said main shaft, wherein said winding knob is connectable to said rotatable element for winding said rubber band;

a main gear within said housing, wherein said main gear is rotated by said activation means, and wherein rotation of said main gear causes said main shaft to rotate on its axis; and a handle, pivotably connected within said housing at a pivot point, comprising anexternal portion extending outside said housing, and further comprising a gear arm, said gear arm engaged with said main gear, wherein rotation of said handle about the pivot point causes said main gear to rotate.

* * * * *